United States Patent [19]

Mollura

[11] 4,297,755

[45] Nov. 3, 1981

[54] NON-PLANAR WATERBED

[76] Inventor: Carlos A. Mollura, 2824 Del Oro Pl., Fullerton, Calif. 92632

[21] Appl. No.: 121,906

[22] Filed: Feb. 15, 1980

[51] Int. Cl.[3] ..... A47C 27/08

[52] U.S. Cl. ..... 5/455; 5/451; 5/453

[58] Field of Search ..... 5/451, 452, 455, 448, 5/449, 450, 453

[56] References Cited

U.S. PATENT DOCUMENTS

| | | | |
|---|---|---|---|
| 3,999,539 | 12/1976 | Meador | 5/451 |
| 4,189,181 | 2/1980 | Noble et al. | 5/455 |
| 4,190,286 | 2/1980 | Bentley | 5/455 |

FOREIGN PATENT DOCUMENTS

| | | | |
|---|---|---|---|
| 274162 | 10/1965 | Australia | 5/455 |
| 1545806 | 5/1979 | United Kingdom | 5/455 |

*Primary Examiner*—Roy D. Frazier
*Assistant Examiner*—Alexander Grosz
*Attorney, Agent, or Firm*—Flam & Flam

[57] ABSTRACT

A bed frame, such as for hospital use, includes a part that may be upwardly inclined. A series of transverse slings suspend a series of individual elongated bag elements. The individual bag elements, when filled with water, merge to form a comfortable and conformable surface. A control system determines and maintains optimum pressure in each of the bag elements as well as in the main horizontal portion of the mattress bag.

3 Claims, 4 Drawing Figures

NON-PLANAR WATERBED

FIELD OF INVENTION

This invention relates to waterbeds and, particularly, to waterbeds designed for use by hospital patients or the like.

BACKGROUND OF THE INVENTION

The significant utility of waterbeds by bed patients has been recognized for a long, long time. U.S. Pat. No. 254,265 issued in 1882 to Edwin James Bone suggested a waterbed structure for bed patients to reduce the possibility of bed sores.

Bed patients often require a reclining back, particularly during waking hours. If bulky pillows or other supplemental supports are used, the value of the fluid suspension is lost. One of the objects of the present invention is to provide a simple reclining back waterbed that provides fluid support not only when the back is horizontal, but also when it is tilted.

The water contained in a waterbed mattress or bag may be entirely unstressed, or it may be somewhat pressurized. This depends upon the relationship of the plastic containing the water, the degree of fill, the nature of the peripheral support for the bag and the load or weight of the person occupying the bed. For ordinary domestic use, it was suggested by early waterbed pioneers that complete flotation was most desirable for restful sleep. Flotation was made possible by providing a rigid peripheral support and a degree of fill short of that sufficient to stress the top plastic layer. It is now recognized that complete flotation is disturbing. A substantial firmness is required even for domestic use. For hospital use, however, the degree of firmness becomes quite critical to patient comfort. It is believed that maximum comfort and the minimum possibility of bed sores is achieved if the fluid pressure of the body of the bed occupant equates to or closely relates to the fluid pressure of the mattress itself. Accordingly, it is another object of this invention to provide a tilting hospital bed that provides control of fluid pressure throughout the operative area of the bed.

SUMMARY OF INVENTION

In order to accomplish the foregoing objectives, I provide a bed frame in which the tilting portions are provided with a series of transverse slings for suspending a series of individual elongated bag elements. The slings, while of fabric webbing, are recessed beneath the surface of the bed so that the upper portions of the individual bag elements merge to form a comfortable body conformable surface. When the frame is tilted, the bag elements exert pressure one on the other through the slings. A control system determines and maintains optimum pressure in each of the bag elements as well as in the main mattress bag.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention, since the scope of the invention is best defined by the appended claims.

Figure 1:
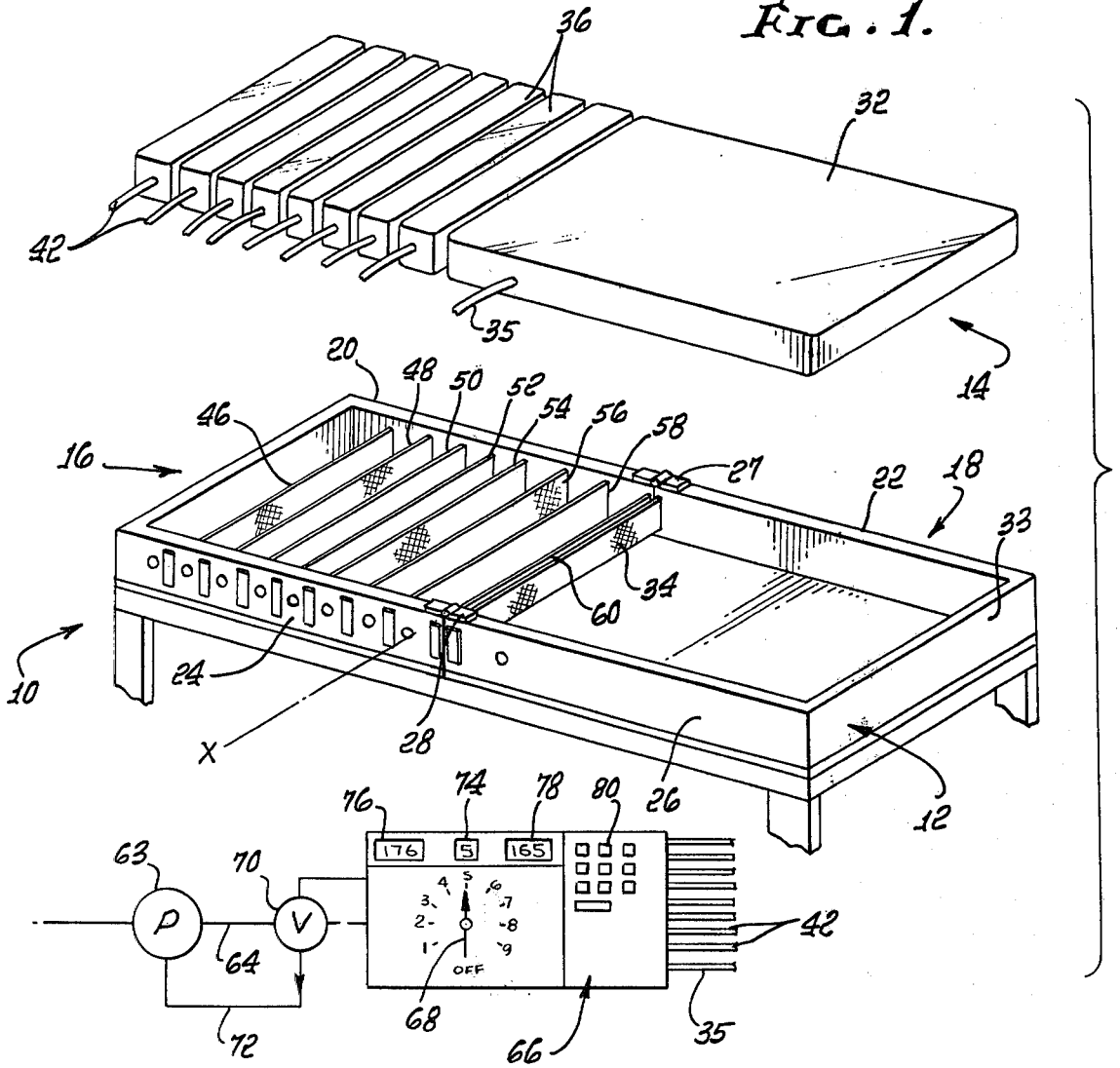
FIG. 1 is a composite and diagrammatic view of a waterbed incorporating the present invention, the mattress bag being shown in superimposed relationship to the frame for purposes of illustration.
Figure 2:
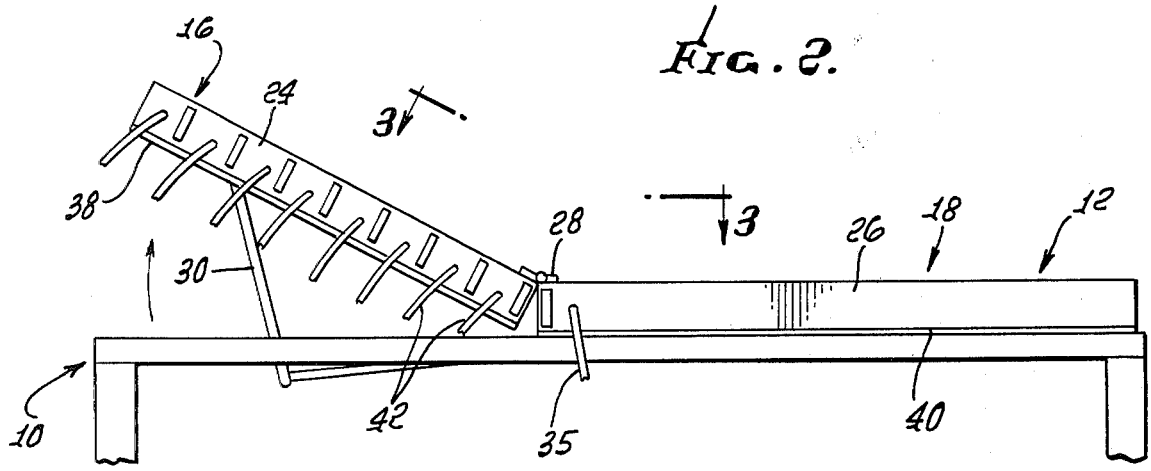
FIG. 2 is a diagrammatic view of the waterbed shown in tilted position.

The waterbed shown in FIG. 1 includes a sturdy support 10, a box like frame 12 and a composite bag structure 14. The frame 10 is divided into two sections 16 and 18 for the head and foot ends of the bed, respectively. The head and foot sections are generally U-shaped, each complementing the other to provide a rectangular structure. The frame sections 16 and 18 include aligned side frame members 20, 22 and 24, 26 that are pivotally connected together for tilting movement of the head frame section 16 about a horizontal axis x. The axis x extends transversely across the top of the bed. For this purpose, suitable hinges 27 and 28 are provided. A motorized linkage structure (FIG. 2) may be provided for moving the head section 16 to a desired position. The foot section 18 of the frame provides a recess of suitable depth, such as about 10 inches, for reception of a main waterbed bag 32. The bag 32 preferably is made as a parallelepiped to fit the frame such as in accordance with my U.S. Pat. No. 3,825,172.

One end wall of the bag 32 fits against the end frame element 33 of the frame section 18. A support for the opposite end wall of the main bag 32 is provided by a nylon or other fabric web 34. The web 34 extends across the open frame and has its ends returned along the outside of the frame elements 22 and 26 where they are securely fastened. The web 34 extends in a vertical plane in line with the hinge axis x. The main bag 32 has a filler tube 35 that extends through a small hole in the side frame element 26.

Figure 3:
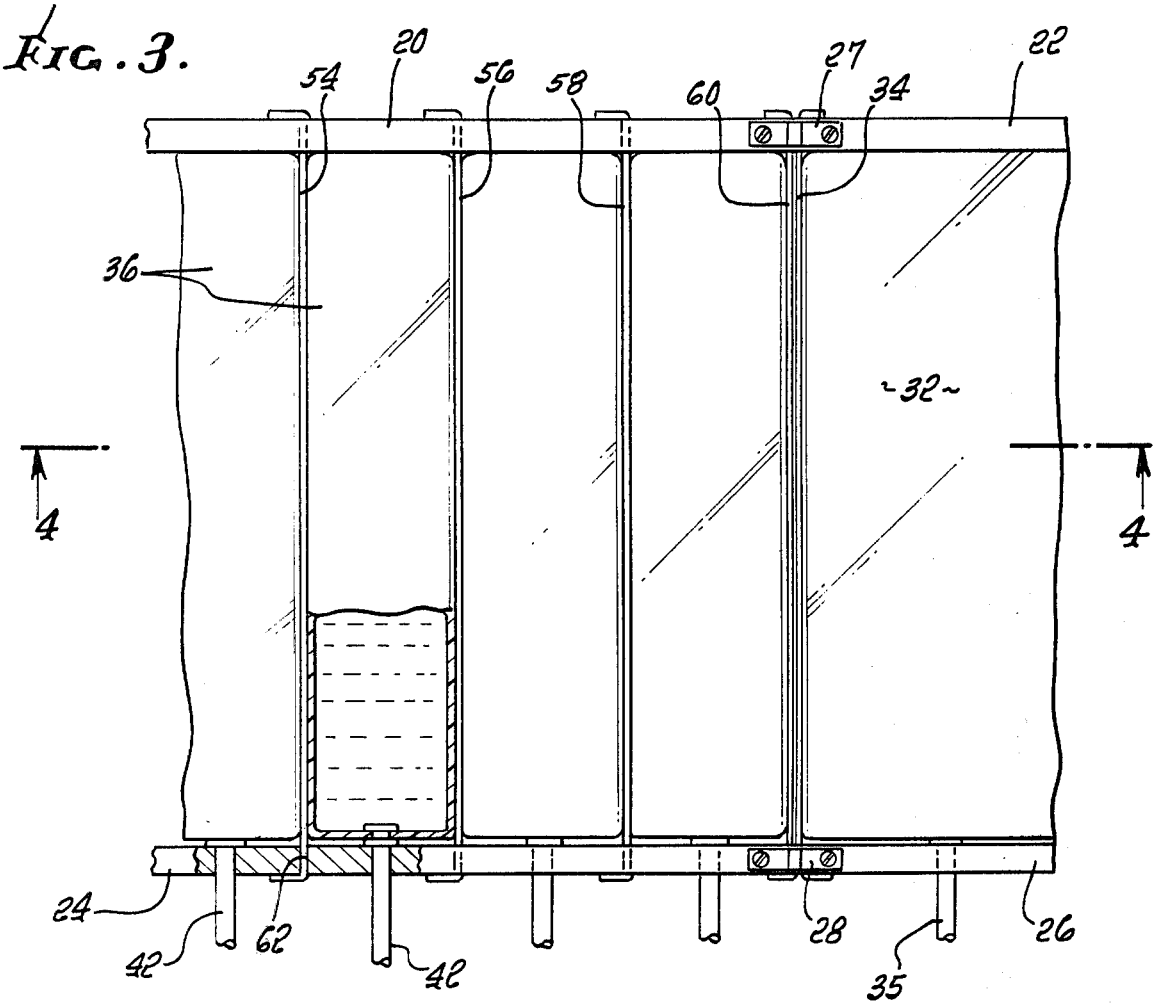
FIG. 3 is a fragementary plan view of the waterbed, one of the mattress bag elements being broken away and shown in section.
Figure 4:
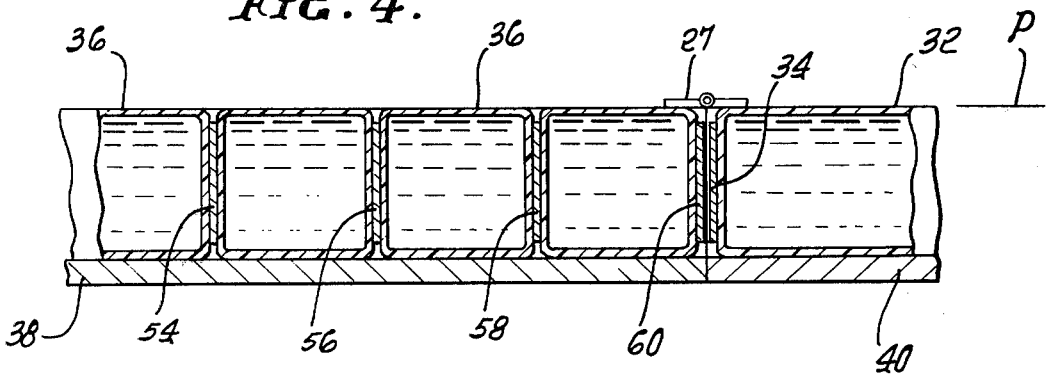
FIG. 4 is a fragmentary vertical sectional view taken along a plane corresponding to line 4—4 of FIG. 3.

The head section 16 of the frame 10 supports a series (eight, in this instance) of individual waterbed bag elements 36. The bags are identical and, preferably, made as elongated parallelepipeds. The bags elements 36 as shown clearly in FIGS. 3 and 4 are arrayed in side-by-side relationship in the upper frame section 16 and rest upon a common plate 38 extending across and fastened to the bottom of the frame section 16. A similar bottom plate 40 is provided for the companion frame section 18. When the frame section 16 is lowered, the bag elements and the main bag 32 have upper surfaces that nominally fall in a common plane p. The bag elements each have a filler tube 42 extending through a corresponding hole in the side frame element.

When the frame section 16 is tilted up, the bag elements 36 filled with water represent a considerable weight. They tend to sag and to bulge out of the frame element. To hold the bag elements in place, supports in the form of a series of slings 46, 48, 50, 52, 54, 56, 58 and 60 (FIG. 1) are provided. The supports or slings are in the form of fabric webs that extend across the frame section 16 and define individual pockets or spaces for the bag elements. One sling is provided for each bag element. The sling 60 for the lowermost bag element, that is to say, the bag element near the hinge axis x, extends across the open end of the frame section 16 with ends returned along the outsides of the frame elements 20 and 24 for firm attachment. When the frame section 18 is horizontal, the web or sling 60 contacts the web 34 for the main bag 32 as shown in FIG. 4.

The other slings or webs 46, 48, 50, 52, 54, 56 and 58 each have ends extending through corresponding slots 62 (FIG. 3) in the frame elements 20 and 24, with ends returned and firmly attached to the frame elements. Each of the slings or webs has a height that closely corresponds to that of the bag elements, the top edge of each web terminating slightly short of the common top plane p.

The spacing between the webs or slings corresponds to the nominal width of the bag elements. The upwardly protruding or projecting portions of the bag elements and main bag move into intimate fluid-like contact one with the next so that the surface presented to the body of the user is essentially free of discontinuities.

When the frame section 16 is tilted upwardly, the webs or slings act individually to support the corresponding bag element to prevent it from sagging or flowing. Accordingly, fluid characteristics of a waterbed are provided in an inclined structure. Similarly, the lower frame section 18, or part of it, could be provided with individual bag elements to allow the bed to assume any desired contour while maintaining waterbed characteristics.

In order to balance the waterbed no matter what the orientation of the tiltable frame section(s) may be, thereby to achieve desired equilibrium with the fluid system to the occupant, a control system (FIG. 1) is provided. The control system operates with a pump 63, the output 64 of which is selectively connected to one of the eight filler tubes 42 and the filler tube 35 for the main bag 32. A distributor 66 is provided for this purpose. The distributor 66 includes a manual selector 68 bearing suitable legends corresponding to the filler tubes and bag elements or main bag.

Between the distributor 66 and the pump output 64 is a three way valve 70 that, in one position, locks the fluid in the line or conduit, that in a second position connects the pump output to the corresponding line, and that in a third position connects the corresponding line to the pump return 72. Accordingly, the individual bag elements and the main bag can be filled and emptied to the desired degree. In order to operate the three way valve 70, suitable control means are provided.

The control means include a control panel having a display 74 that indicates by number the bag element or component that is on line, a display 76 that reads fluid pressure of the bag component on line, and a display 78 that reads the desired or previous pressure setting of the bag component. The control means further includes ten key digital input switches 80 for changing the setting desired for each of the bag components. Thus, operation of key switches change the reading at display 78. The control means includes suitable closed loop feedback or digital control means to operate the three way valve in accordance with the difference, if any, between the actual bag pressure at display 76 and the set pressure at display 78.

The entire system is easily adjusted to achieve optimum comfort for the bed patient. Change of the angle of the frame section 18 merely requires that the attendant move the selector 68 through its stations to achieve correspondence between the actual pressure and the set pressure. Optionally, change in frame section elevation automatically causes the selector or control means to proceed through its stations.

Intending to claim all novel, useful and unobvious features shown or described, I make the following claims:

1. In a waterbed structure:

(a) a waterbed frame including a plurality of sections, at least one of which is inclined, said one frame section having side walls;

(b) a series of supports extending across the inclined frame section and defining a series of individual pockets for waterbed bag elements;

(c) a series of individual waterbed bag elements in said pockets and supported by said supports;

(d) waterbed bag means for the remaining section or sections of said frame;

(e) said waterbed bag elements being contiguous with each other to provide an integral substantially flat support surface adjoining said waterbed bag means;

(f) each of said supports being structurally connected to said side walls of said frame whereby said supports sustain components of the weight of said bag elements in said pockets.

2. The waterbed structure as set forth in claim 1 in which said supports are in the form of flexible webs recessed beneath said support surface.

3. In a waterbed structure:

(a) a waterbed frame including a plurality of sections including a head section pivotally connected to another section for angular movement about a substantially horizontal axis to incline said head section;

(b) said head section having an end frame element and side frame elements;

(c) a series of flexible slings extending across said head section and having ends respectively secured to the said side frame elements of said head section, said slings defining a series of individual elongated spaces for waterbed bag elements;

(d) a series of individual waterbed bag elements in said spaces and supported by said slings;

(e) waterbed bag means for the rest of said frame;

(f) said waterbed bag elements being contiguous with each other to provide an integral substantially flat support surface, said slings having edges recessed beneath the top support surface.

* * * * *